US006521898B2

(12) United States Patent
Chutjian et al.

(10) Patent No.: US 6,521,898 B2
(45) **Date of Patent: *Feb. 18, 2003**

(54) HIGH-EFFICIENCY ELECTRON IONIZER FOR A MASS SPECTROMETER ARRAY

(75) Inventors: Ara Chutjian, La Crescenta, CA (US); Murray R. Darrach, Arcadia, CA (US); Otto J. Orient, Glendale, CA (US)

(73) Assignee: California Institute of Technology, Pasadena, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/903,475

(22) Filed: Jul. 10, 2001

(65) Prior Publication Data

US 2001/0038077 A1 Nov. 8, 2001

Related U.S. Application Data

(63) Continuation of application No. 09/588,991, filed on Jun. 6, 2000, now Pat. No. 6,271,527, which is a continuation of application No. 09/165,176, filed on Oct. 1, 1998, now Pat. No. 6,072,182.

(60) Provisional application No. 60/060,895, filed on Oct. 3, 1997.

(51) Int. Cl.[7] ..... H01J 49/14

(52) U.S. Cl. ..... 250/427; 250/423 R; 250/288

(58) Field of Search ..... 250/427, 423 R, 250/288

(56) References Cited

U.S. PATENT DOCUMENTS

| | | | | | |
|---|---|---|---|---|---|
| 3,247,373 | A | * | 4/1966 | Herzog et al. | 250/427 |
| 4,313,911 | A | * | 2/1982 | Moran et al. | 250/427 |
| 4,943,718 | A | * | 7/1990 | Haines et al. | 250/427 |
| 5,756,996 | A | * | 5/1998 | Bier et al. | 250/427 |
| 6,072,182 | A | * | 6/2000 | Chutjian et al. | 250/427 |
| 6,271,527 | B1 | * | 8/2001 | Chutjian et al. | 250/427 |

* cited by examiner

*Primary Examiner*—Kiet T. Nguyen
(74) *Attorney, Agent, or Firm*—Fish & Richardson P.C.

(57) ABSTRACT

The present invention provides an improved electron ionizer for use in a quadrupole mass spectrometer. The improved electron ionizer includes a repeller plate that ejects sample atoms or molecules, an ionizer chamber, a cathode that emits an electron beam into the ionizer chamber, an exit opening for excess electrons to escape, at least one shim plate to collimate said electron beam, extraction apertures, and a plurality of lens elements for focusing the extracted ions onto entrance apertures.

27 Claims, 4 Drawing Sheets

HIGH-EFFICIENCY ELECTRON IONIZER FOR A MASS SPECTROMETER ARRAY

CROSS-REFERENCE TO RELATED APPLICATIONS

This is a continuation of U.S. application Ser. No. 09/588,991, filed Jun. 6, 2000 now U.S. Pat. No. 6,271,527, which is a continuation of U.S. application Ser. No. 09/165,176, filed Oct. 1, 1998 (now U.S. Pat. No. 6,072,182), which claims benefit of the priority of U.S. Provisional Application Ser. No. 60/060,895, filed Oct. 3, 1997.

ORIGIN OF INVENTION

The invention described herein was made in performance of work under a NASA contract, and is subject to the provisions of Public Law 96-517 (35 U.S.C. 202) in which the Contractor has elected to retain title.

TECHNICAL FIELD

The invention relates to an improved electron ionizer for a mass spectrometer array for the separation of ions with different masses.

BACKGROUND

A quadrupole mass spectrometer separates ions with different masses by applying a DC voltage and an rf voltage on four rods having circular or hyperbolic cross sections and an axis equidistant from each rod. Sample ions enter this cross sectional area through an aperture at the ends of the rods. The variation of the applied rf voltages on the four rods selects sample ions of a certain mass-to-charge ratio (m/e) to exit the quadrupole mass spectrometer to be detected. Sample ions with different m/e values either impact the rods and are neutralized or deflected away from the axis of the quadrupole.

A miniature quadrupole mass spectrometer array is described in U.S. Pat. No. 5,596,193, the disclosure of which is herein incorporated by reference.

FIG. 1 shows a block diagram of a typical prior art quadrupole mass spectrometer 100 constructed of 16-rod electrodes 106 in a 4×4 array to form nine separate quadrupole regions. Ionization of a gas sample begins in an ionizer chamber within an ionizer 102. Sample atoms or molecules are injected into this chamber where they are intercepted by electron beams and are ionized to positive ions. These are then extracted through the entrance apertures 104 of the quadrupole mass spectrometer 100 and are detected.

Electron ionizers, as used in mass spectrometers, have applications in environmental monitoring, semiconductor etching, residual gas analysis in laboratory vacuum chambers, monitoring of manufacturing plants against toxic substances, protection of buildings, harbors, embassies, airports, military sites, and power plants against terrorist attacks.

SUMMARY

The inventors noticed that the existing electron ionizers are relatively inefficient. They found that the electron beams are not passing to a proper area, near enough to the entrance apertures 104. Hence, those apertures are "starved" for ions. Proportionately more electrons escape out the exit than are extracted as ions through the entrance apertures 104. Even those apertures that have coverage lack efficient ion transport means to optimally focus ions onto the quadrupolar regions.

The system disclosed herein meets these drawbacks by using an electron beam collimator, preferably, at least one shim plate 310, to collimate an electron beam 306 emitted from a cathode 302. The electron beam intercepts sample atoms and molecules ejected from a repeller plate 312 and ionizes them to positive ions. The ions are then extracted by static fields formed by a repeller plate 312 and a first lens element 316. Three lens elements 316, 408 and 410 extract and focus these ions onto entrance apertures 412.

BRIEF DESCRIPTION OF THE DRAWINGS

Like reference numbers and designations in the various drawings indicate like elements.

DETAILED DESCRIPTION

Figure 1:
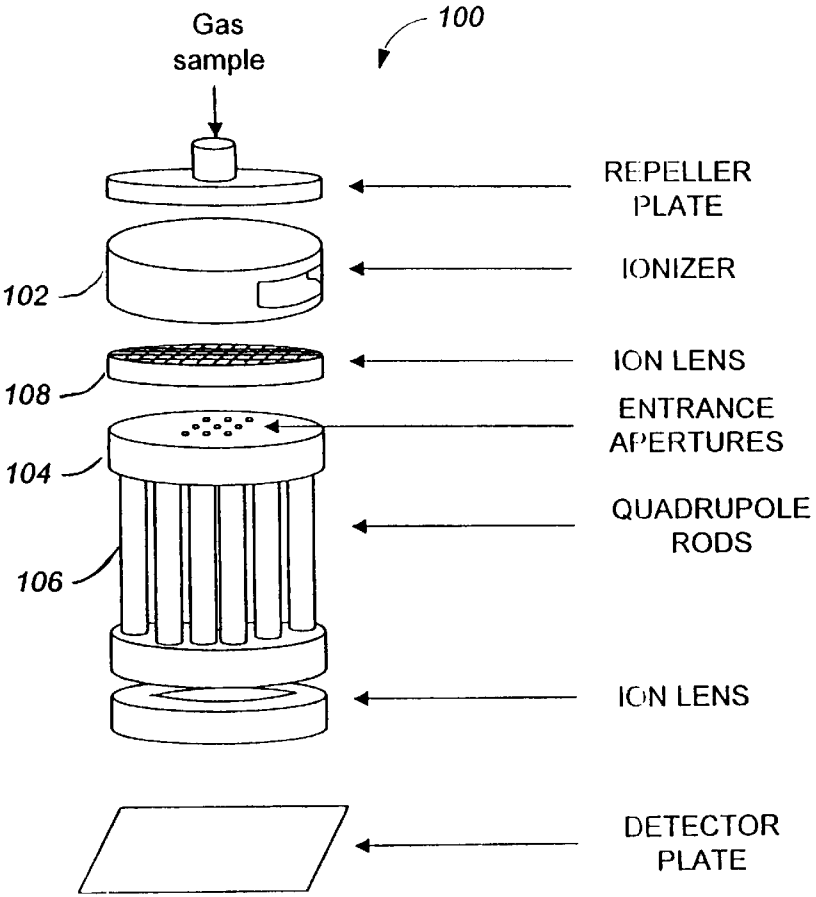
FIG. 1 (PRIOR ART)
FIG. 1 is a block diagram of a typical prior art quadrupole mass spectrometer constructed of 16-rod electrodes in a 4×4 array to form nine separate quadrupole regions.
Figure 2A:
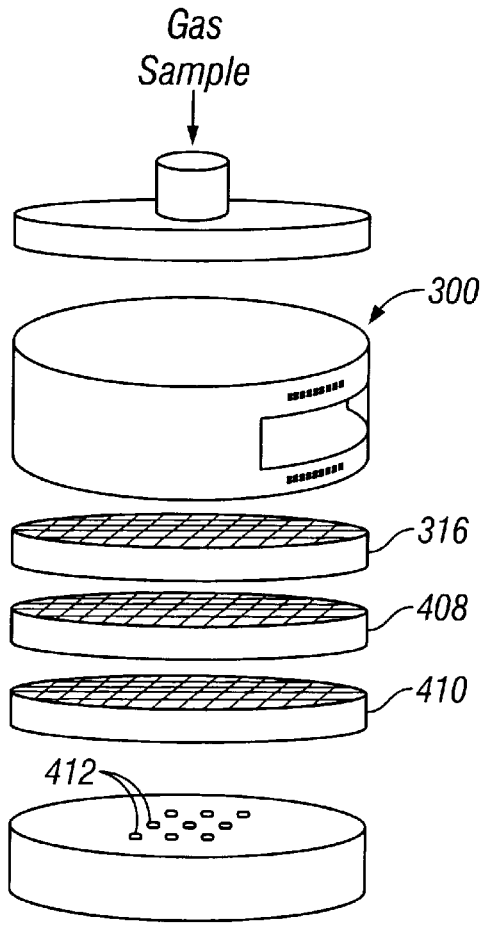
FIGS. 2(A–B) are block diagrams of an improved electron ionizer with a direction of cross-sectional views of FIGS. 3 and 4 shown.
Figure 2B:
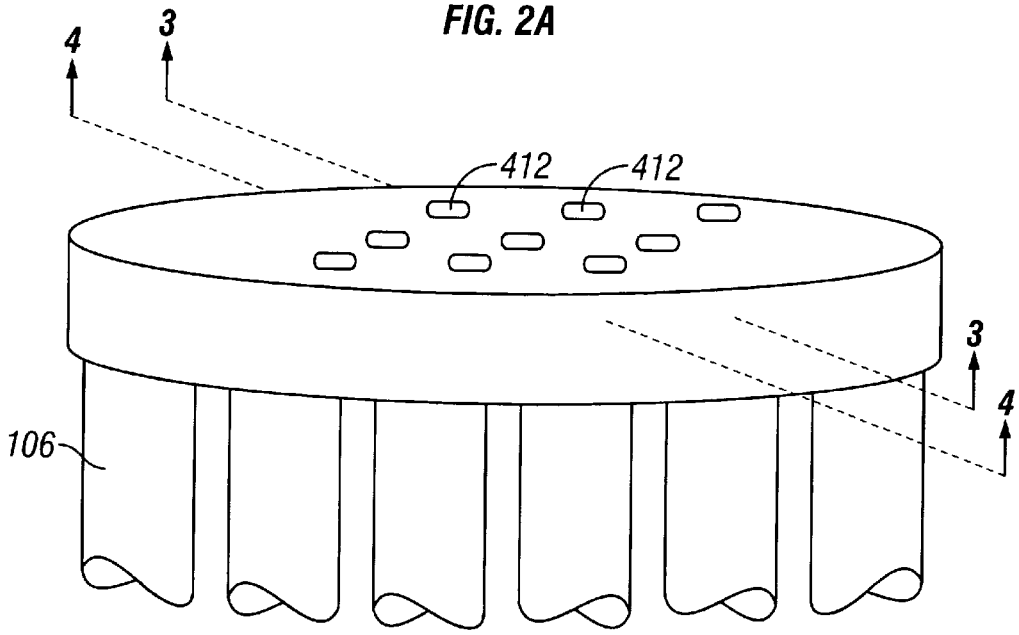
Figure 3:
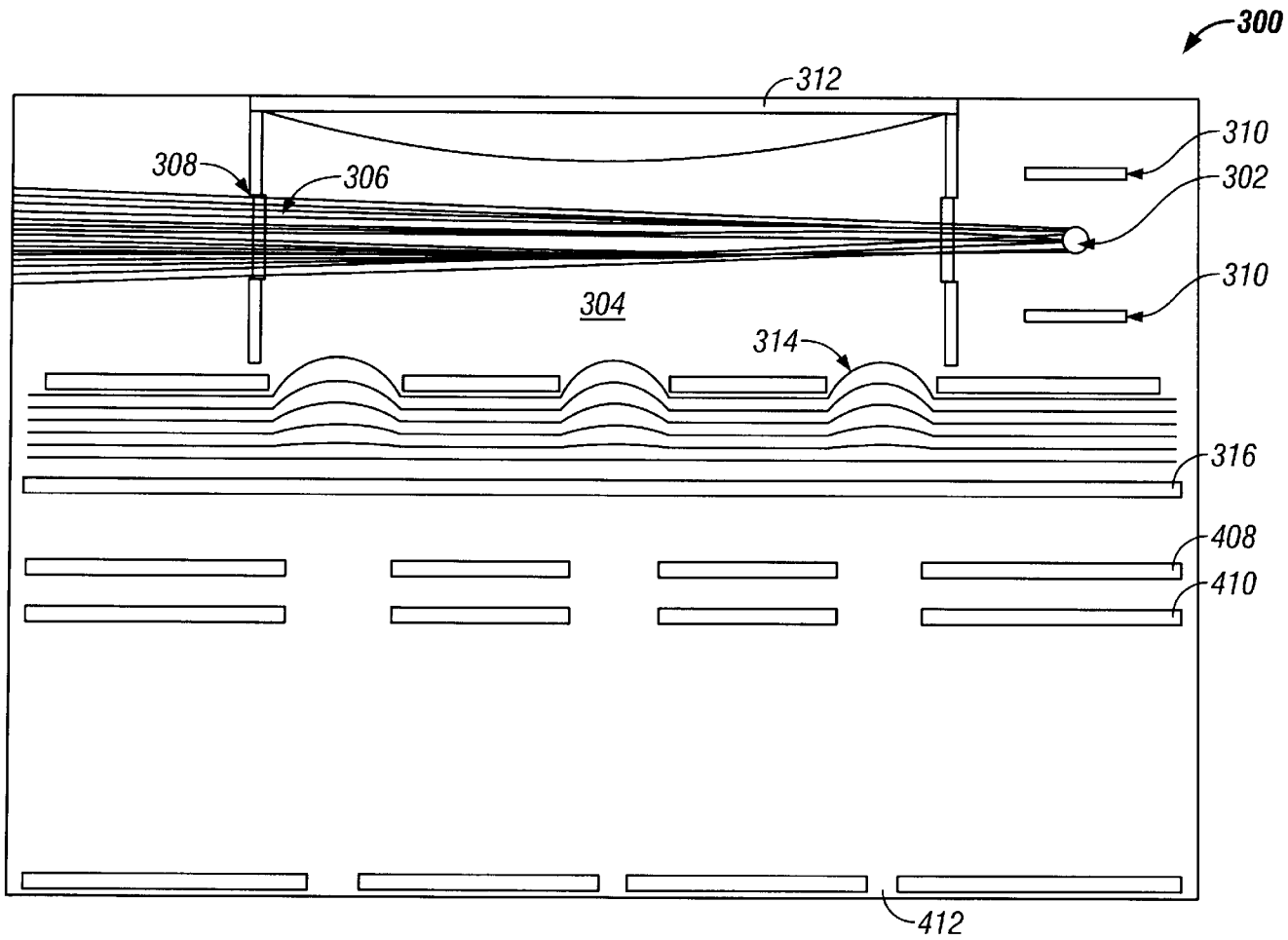
FIG. 3 is a cross-sectional view of an improved electron ionizer.
Figure 4:
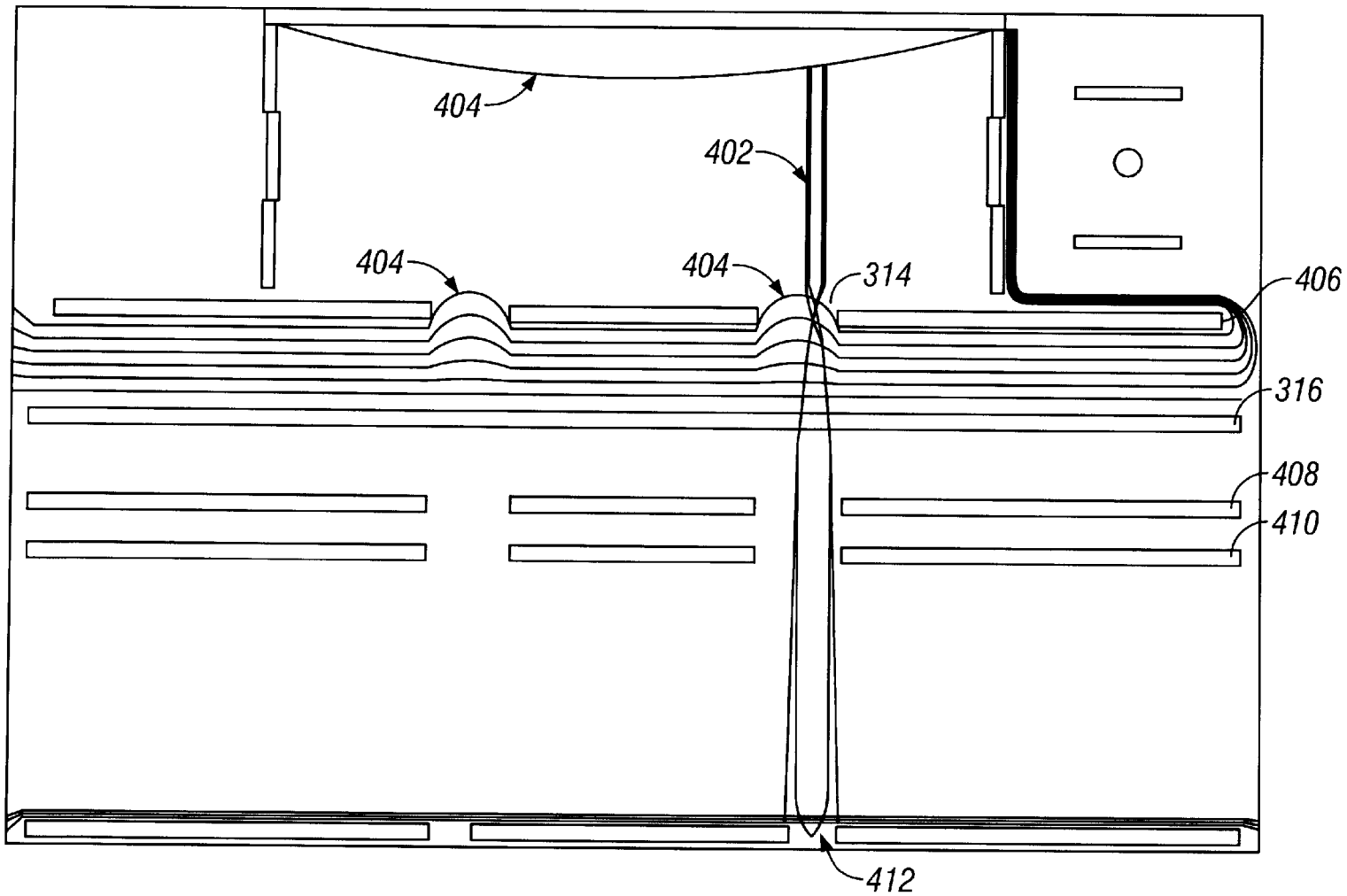
FIG. 4 is a different cross-sectional view of an improved electron ionizer with edge apertures shown.

The present disclosure describes an improved electron ionizer for use in a quadrupole mass spectrometer array. A diagram of an improved electron ionizer is shown in FIG. 2A with directions of cross-sectional views of FIGS. 3 and 4 shown in FIG. 2B. An improved electron ionizer 300, shown in FIG. 3, includes a repeller plate 312, an ionizer chamber 304, a cathode 302 that emits an electron beam 306 into the ionizer chamber 304, an exit opening 308 allowing for excess electrons to escape, at least one shim plate 310, extraction apertures 314, and a plurality of lens elements 316, 408 and 410 for focusing the extracted ions onto entrance apertures 412.

The cathode 302 is formed from a straight wire perpendicular to the plane of FIG. 3. The cathode 302 is biased at approximately −70 V relative to the ground. The cathode 302 emits an electron beam 306, for example, in the form of a ribbon beam, into the ionizer chamber 304. Excess electrons not extracted as ions then exit through the opening 308 at the left end of the ionizer chamber 304. Typical emission currents used by the cathode 302 are 300 to 1000 $\mu$A. In a preferred mode, the cathode 302 uses an emission current of 500 $\mu$A. The electron beam 306 emitted from the cathode 302 is collimated by at least one shim plate 310. The at least one shim plate 310 is biased at approximately −100 V. In preferred embodiments, two shim plates 310 are provided. However, any device that focuses or collimates the electron beam toward the openings could be alternately used.

A repeller plate 312 ejects sample atoms and molecules toward grounded extraction apertures 314 filling the ionizer chamber 304. The electron beam 306 intercepts sample atoms and molecules and ionizes them to positive ions. The ions are then extracted by static fields which are set up by the geometry and potential of the repeller plate 312, and a first lens element 316. The repeller plate 312 is biased at approximately +2 V while the first lens element 316 is biased at approximately −8 V. Hence the beam is collimated to the right spot and the ions are pushed through the opening.

FIG. 4 shows trajectories of the positive ions 402 that are formed by the electron beam 306 and extracted by the static fields 404. A slightly different cross-section than FIG. 3 is taken to illustrate typical extraction difficulties experienced by edge extraction apertures 406. Also, the electron beam 306 is omitted for clarity. Appropriate geometry and potential of the repeller plate 312 and the first lens element 316 allow electron beam 306 to form ions above these edge extraction apertures 406. Lens elements 316, 408 and 410 then extract and focus these ions onto entrance apertures 412. A second lens element 408 is biased at approximately −25 V and placed at approximately 1 mm from the first lens element 316. A third lens element 410 is biased at approximately −200 V and placed at approximately 1 mm from the second lens element 408.

A number of embodiments of the present invention have been described. Nevertheless, it will be understood that various modifications may be made without departing from the spirit and scope of the invention. For example, while the invention has been described in terms of nine extraction apertures with cross-sectional figures showing two and three extraction apertures, the invention may be implemented with any number of extraction apertures. Also, while the invention has been described in terms of three lens elements, it may be implemented with any number of lens elements. Accordingly, other embodiments are within the scope of the following claims.

What is claimed is:

1. An ionizing apparatus comprising:

an ionization chamber into which molecules are introduced;

an electron source configured to emit an electron beam into the ionization chamber to ionize molecules into ions;

a plurality of extraction apertures through which ions are extracted, said plurality of extraction apertures being arranged in a pattern corresponding to a pattern formed by a plurality of entrance apertures;

a plurality of lens elements, each of said plurality of lens elements being configured to extract ions from one of said plurality of extraction apertures and to focus the ions into an ion stream directed to a corresponding one of said plurality of entrance apertures; and a collimator operative to collimate the electron beam emitted from the electron source such that substantially all of the extraction apertures are covered by the electron beam.

2. The apparatus of claim 1 in which the collimator comprises one or more shim plates.

3. The apparatus of claim 2 in which each of the one or more shim plates is biased at approximately −100 Volts.

4. The apparatus of claim 1 in which the electron source is configured to emit an electron beam that substantially covers all of the extraction apertures.

5. The apparatus of claim 1 in which the electron source comprises a cathode that emits a ribbon beam of electrons.

6. The apparatus of claim 5 in which the extraction apertures are arranged in a plane and in which the ribbon beam of electrons is emitted parallel to the plane of extraction apertures.

7. The apparatus of claim 1 in which the electron source comprises a substantially straight wire cathode.

8. The apparatus of claim 7 in which the extraction apertures are arranged in a plane and in which the wire cathode is oriented parallel to the plane of extraction apertures.

9. The apparatus of claim 7 in which the wire cathode is biased at approximately −70 Volts.

10. The apparatus of claim 1 in which the plurality of lens elements comprises:

a first lens element;

a second lens element disposed at approximately 1 millimeter from the first lens element; and a third lens element disposed at approximately 1 millimeter from the second lens element.

11. The apparatus of claim 10 in which the first lens element is biased at approximately −8 Volts, the second lens element is biased at approximately −25 Volts, and the third lens element is biased at approximately −200 Volts.

12. The ionizing apparatus of claim 1, wherein each of said entrance apertures in the pattern has a position corresponding to the center of a quadrupole region in an array of rod electrodes.

13. A method of ionizing molecules in a mass spectrometer, the method comprising:

emitting an electron beam into an ionization chamber to ionize sample molecules;

providing a plurality of ion extraction apertures arranged in a pattern and to be substantially co-planar;

collimating the emitted electron beam to substantially cover each of the plurality of ion extraction apertures;

extracting ions from the plurality of ion extraction apertures; and focusing ions extracted from each of said plurality of extraction apertures to a corresponding one of a plurality of entrance apertures arranged in a pattern.

14. The method of claim 13 further comprising introducing sample molecules into the ionization chamber.

15. The method of claim 13 in which emitting an electron beam comprises emitting a ribbon beam of electrons from a substantially straight wire cathode.

16. The method of claim 13 in which collimating the emitted electron beam comprises shaping the electron beam using at least one biased shim plate.

17. The method of claim 13 further comprising using a plurality of lens elements to focus ions into the extraction apertures.

18. A molecule sample ionizer for a mass spectrometer comprising:

an ionization chamber configured to receive sample molecules and having a plurality of extraction apertures through which ions are extracted;

a repeller that introduces sample molecules into the ionization chamber;

an electron source that emits an electron beam into the ionization chamber to ionize the sample molecules into ions;

a plurality of lens elements; and a spectrometry chamber having a plurality of entrance apertures, wherein the repeller and one or more of the lens elements are arranged to generate a first static field to extract ions through the ionization chamber's extraction apertures, and wherein the plurality of lens elements are arranged to generate a second static field to urge the ions into the spectrometry chamber's entrance apertures.

19. The ionizer of claim 18 further comprising a collimator that collimates the electron beam emitted from the electron source.

20. The ionizer of claim 19 in which the collimator is configured to collimate the electron beam such that substantially all of the extraction apertures are covered by the electron beam.

21. The ionizer of claim 19 in which the collimator comprises one or more shim plates.

22. The ionizer of claim 21 in which each of the one or more shim plates is biased at approximately −100 Volts.

23. The ionizer of claim 18 in which the electron source comprises a cathode that emits a ribbon beam of electrons.

24. The ionizer of claim 18 in which the electron source comprises a substantially straight wire cathode.

25. The ionizer of claim 24 in which the wire cathode is biased at approximately −70 Volts.

26. The ionizer of claim 18 in which the plurality of lens elements comprises:

a first lens element;

a second lens element disposed at approximately 1 millimeter from the first lens element; and a third lens element disposed at approximately 1 millimeter from the second lens element.

27. The ionizer of claim 26 in which the first lens element is biased at approximately −8 Volts, the second lens element is biased at approximately −25 Volts, and the third lens element is biased approximately −200 Volts.

* * * * *